US006788789B2

(12) United States Patent
Otsuka

(10) Patent No.: US 6,788,789 B2
(45) Date of Patent: Sep. 7, 2004

(54) PHASE CONVERSION SURROUND CIRCUITRY

(75) Inventor: Kazuhito Otsuka, Takasaki (JP)

(73) Assignee: Victor Company of Japan, Ltd. (JP)

( * ) Notice: Subject to any disclaimer, the term of this patent is extended or adjusted under 35 U.S.C. 154(b) by 140 days.

(21) Appl. No.: 10/295,548

(22) Filed: Nov. 15, 2002

(65) Prior Publication Data

US 2003/0108207 A1 Jun. 12, 2003

(30) Foreign Application Priority Data

Dec. 7, 2001 (JP) ..... 2001-373468

(51) Int. Cl.[7] ..... H04R 5/00; H04R 5/02
(52) U.S. Cl. ..... 381/1; 381/307; 381/97
(58) Field of Search ..... 381/1, 17, 18, 381/19, 307, 27, 97; 331/34, 187, 135

(56) References Cited

U.S. PATENT DOCUMENTS 4,415,768 A * 11/1983 Carver ..... 381/10
4,415,862 A * 11/1983 Kunugi ..... 330/10
4,622,878 A * 11/1986 Sharp ..... 84/626
4,980,914 A * 12/1990 Kunugi et al. ..... 381/1
5,119,420 A * 6/1992 Kato et al. ..... 381/1
5,414,774 A * 5/1995 Yumoto ..... 381/1
5,604,808 A * 2/1997 Takeda et al. ..... 381/7
5,717,763 A * 2/1998 Choi et al. ..... 381/1
5,974,153 A * 10/1999 Cashion et al. ..... 381/11
6,449,368 B1 * 9/2002 Davis et al. ..... 381/1
6,636,608 B1 * 10/2003 Kishii et al. ..... 381/18

* cited by examiner

*Primary Examiner*—Xu Mei
(74) *Attorney, Agent, or Firm*—Renner, Kenner, Greive, Bobak, Taylor & Weber

(57) ABSTRACT

A phase-conversion surround circuitry gives surround effects to right- and left-channel audio signals. An audio difference signal between the right- and left-channel audio signals is delayed at a specific time constant. The delayed audio difference signal is combined with the right- and left-channel audio signals, thus composite audio signals being generated. The time constant is periodically varying under oscillation at frequency of 12 Hz or less.

3 Claims, 2 Drawing Sheets

PHASE CONVERSION SURROUND CIRCUITRY

BACKGROUND OF THE INVENTION

The present invention relates to phase-conversion surround circuitry for sound-field reproduction used in audio system.

Audio systems for music-data reproduction from cassette tapes, CDs, MDs, memory cards, DVDS, etc., are usually equipped with a digital surround circuit or an analog phase-conversion (shift) surround circuit, for offering surround effects to create wide sound fields.

Shown in FIG. 1 is a known analog phase-conversion surround circuit 20 equipped with phase-delay units 4 and 5.

Input right- and left-channel audio signals R and L are supplied to two-stage phase (90°)-delay units 4 and 5 via low-frequency amplifiers (operational amplifiers) 1, 2 and 3.

A resultant 180°-delayed signal Δ(R−L) is combined (added/subtracted) with the right- and left-channel audio signals R and L at low-frequency amplifiers (operational amplifiers) 7 and 8, respectively, via an ON/OFF switch SW and an allotter 6, thus composite signals R+Δ(R−L) and L−Δ(R−L) being output.

Three or more stages of the phase-delay units for longer delay time will enhance surround effects (wider sound fields). Nevertheless, the more enhanced surround effects, the more difference in sound quality based on addition/subtraction-resultant composite signals, so that most listeners feel low sound quality. For example, four-stage phase-delay units for 360°-delay could cause that most people cannot listen for a long time. On the contrary, one or two-stage phase-delay units for less delay act like an equalizer and reduce surround effects.

Moreover, the known phase-conversion surround circuit 20 gives a fixed level of surround effects, thus the created sound being not feasible for healing effects with BGM, quiet music, music with full of low-level sounds, etc.

SUMMARY OF THE INVENTION

A purpose of the present invention is to provide a phase-conversion surround circuitry with enhanced surround and healing effects.

The present invention provides a phase-conversion surround circuitry to give surround effects to right- and left-channel audio signals, including: a phase delayer to delay an audio difference signal between the right- and left-channel audio signals, thus outputting a delayed audio difference signal; a combiner to combine the delayed audio difference signal with the right- and left-channel audio signals, thus outputting composite audio signals; and a controller to oscillate at frequency of 12 Hz or less to periodically vary a time constant of the phase delayer.

DETAILED DESCRIPTION OF PREFERRED EMBODIMENT

A preferred embodiment according to the present invention will be disclosed with reference to the attached drawings.

Figure 1:
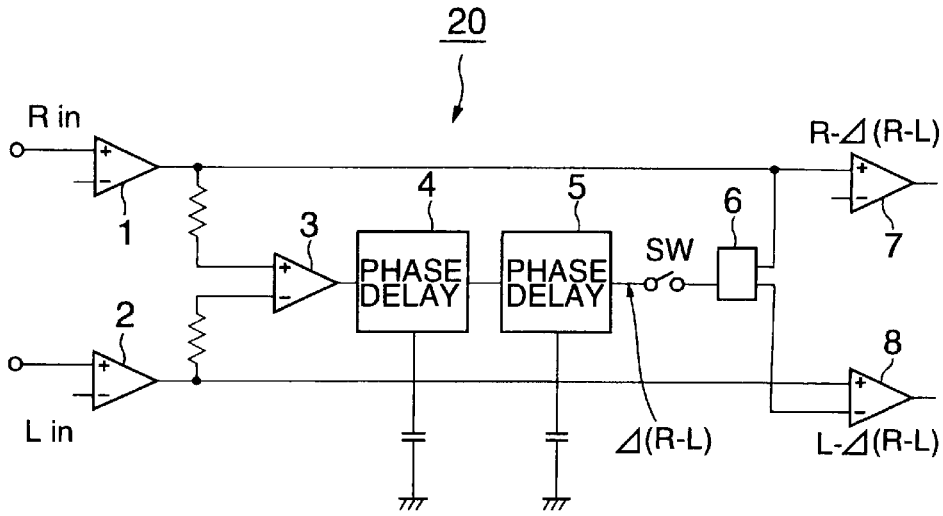
FIG.1 (RELATED ART)
FIG. 1 is a circuit diagram of a known analog phase-conversion surround circuit.

Elements in the embodiment which will be disclosed below, that are the same as or analogous to the elements shown in FIG. 1 are referenced by the same reference numbers.

Figure 2:
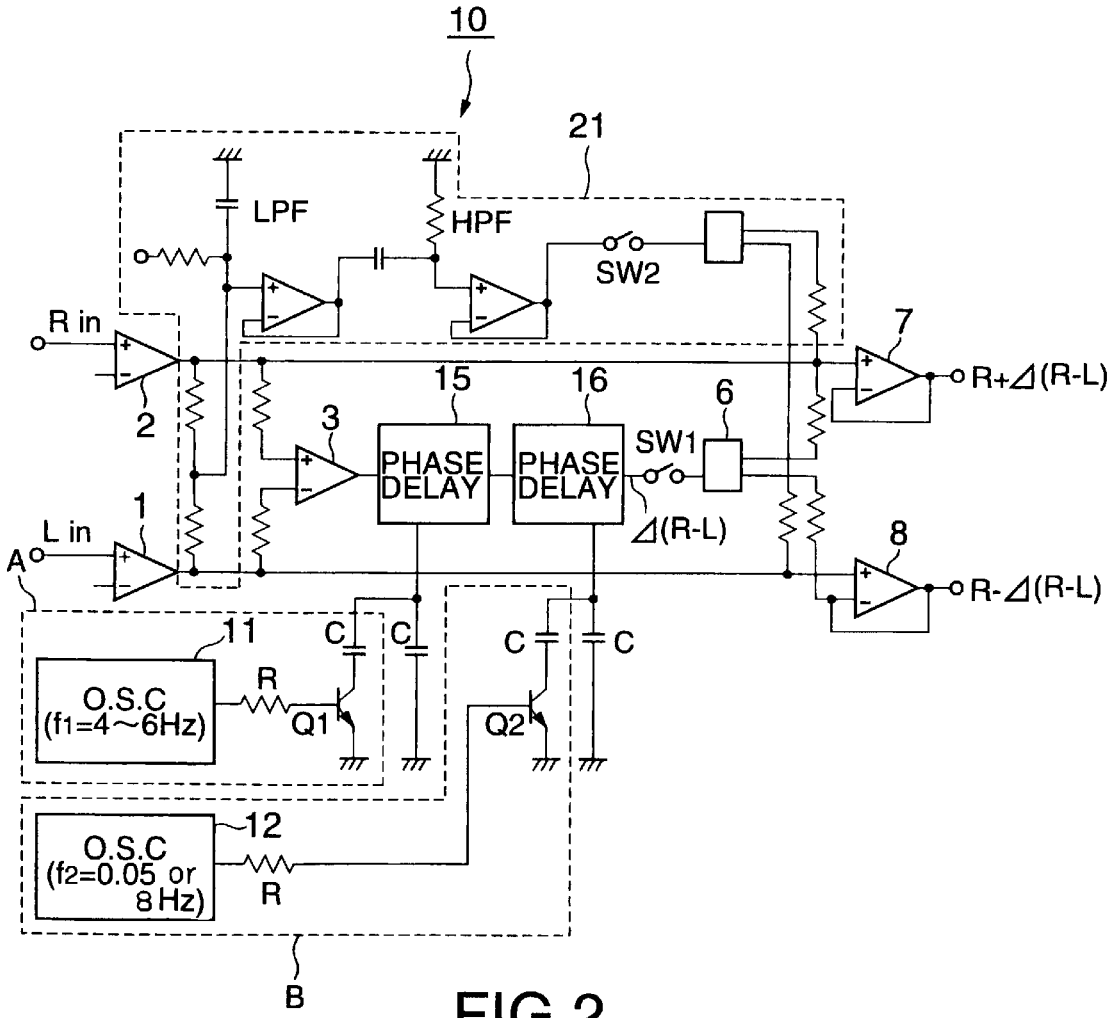
FIG. 2 is a circuit diagram of a phase-conversion surround circuitry according to the present invention.

Disclosed with reference to FIG. 2 is a phase-conversion surround circuitry according to the present invention.

A phase-conversion surround circuitry 10 shown in FIG. 2 is equipped with phase-delay controllers A and B, and a band-pass filter 21, in addition to a surround circuit, similar to the counterpart 20 shown in FIG. 1, except two-stage phase (90°)-delay units 15 and 16 controlled under the controllers A and B.

Input right- and left-channel audio signals R and L are supplied to a low-frequency amplifier 3 via low-frequency amplifiers 1 and 2. The low-frequency amplifiers 1, 2 and 3 may be an operational amplifier.

A difference signal (R−L) output of the low-frequency amplifier 3 is supplied to the two-stage phase (90°)-delay units 15 and 16, and thus delayed by 180 degrees under phase modulation, while controlled by the phase-delay controllers A and B.

A resultant 180°-delayed signal Δ(R−L) is combined (added/subtracted) with the right- and left-channel audio signals R and L at low-frequency amplifiers (operational amplifiers) 7 and 8, respectively, via an ON/OFF switch SW1 and an allotter 6, thus composite signals R+Δ(R−L) and L−Δ(R−L) being output.

During this operation, the phase-delay units 15 and 16 are controlled for their time constant by the phase-delay controllers A and B. The controllers A and B are equipped with low-frequency oscillators 11 and 12, respectively, oscillating at a frequency of 12 Hz or lower, to minimize the difference in sound quality based on addition/subtraction-resultant composite signals.

In detail, the low-frequency oscillator 11 oscillates at a frequency f1 in the range from 4 to 6 Hz whereas the low-frequency oscillator 12 oscillates at a frequency f2 of 0. 05 Hz or 8 Hz which is the better choise.

The oscillator 11 is connected, via a resistor R, to the base of an NPN-type transistor Q1 with the emitter grounded. The corrector of the transistor Q1 is connected to the first-stage phase-delay unit 15 via a capacitor C.

Likewise, the oscillator 12 is connected, via a resistor R, to the base of an NPN-type transistor Q2 with the emitter grounded. The corrector of the transistor Q2 is connected to the second-stage phase-delay unit 16 via a capacitor C.

The oscillators 11 and 12 give a constant fluctuation to the 180°-delayed signal Δ(R−L), the output of the second-stage phase-delay unit 16, for creating natural and comfortable sound (healing surround effects).

The oscillators 11 and 12 may oscillate at any frequency in the range from 4 to 12 Hz, preferably from 4 to 12 Hz. Especially, in this embodiment, the oscillators 11 and 12 oscillate at different frequencies f1 (from 4 to 6 Hz) and f2 (0. 05 or 8 Hz) to give different cycle of fluctuation to the phase-delay units 15 and 16, respectively, for enhanced surround effects with emphasized tone difference.

Figure 3:
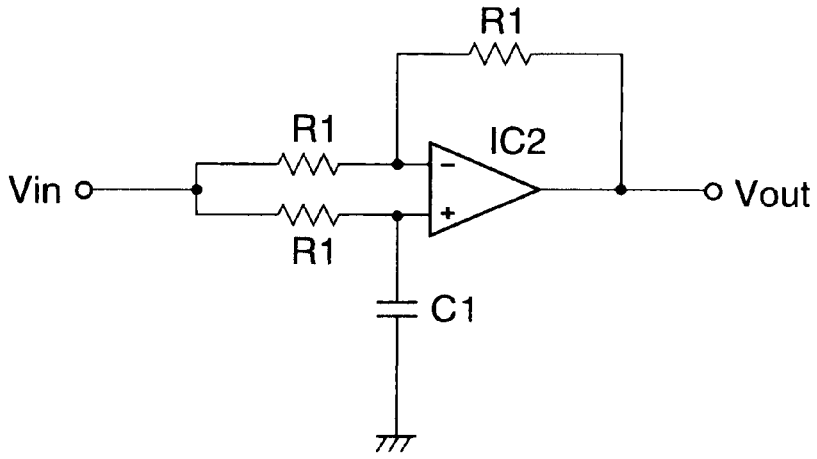
FIG. 3 is a circuit diagram of a phase-delay unit involving operational amplifiers for the phase-conversion surround circuitry according to the present invention.

FIG. 3 shows an exemplary circuit diagram, involving operational amplifiers, for the phase-delay units 15 and 16.

This circuit functions as an all-pass filter which gives $Vout/Vin=(1-j\omega R1C1)/(1+j\omega R1C1)=1$, thus no change between input/output levels and hence the gain is 1 while input/output phases vary within a range under an angular frequency $\omega$ at a time constant $C1\times R1$.

Change in capacitance C1 in the phase-delay units 15 and 16 gives phase modulation and fluctuation to the delayed output.

Figure 4:
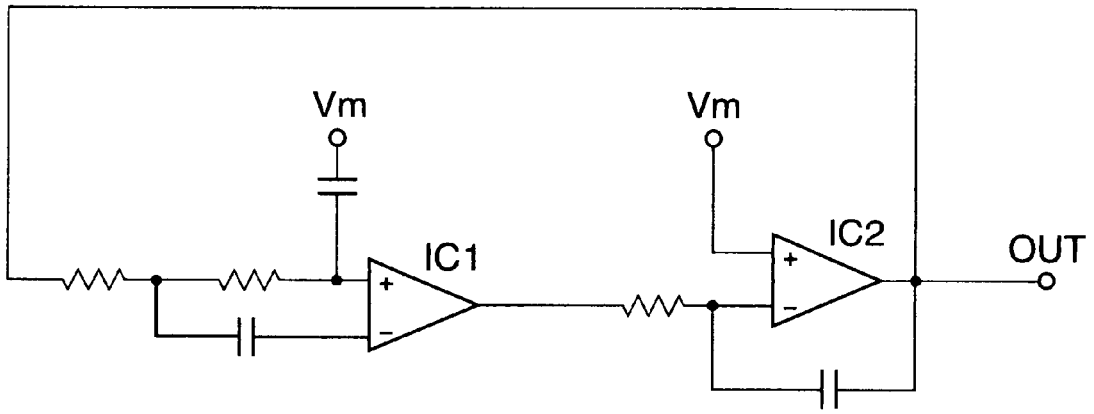
FIG. 4 is a circuit diagram of a low-frequency oscillator for the phase-conversion surround circuitry according to the present invention.

FIG. 4 shows an exemplary circuit diagram of an LPF-integrator-coupled loop oscillator for the low-frequency oscillators 11 and 12. A voltage Vm is supplied to each positive input terminal of operational amplifiers IC1 and IC2.

The signal processing in the phase-conversion delay units 15 and 16 (FIG. 2) in the embodiment and the counterparts 4 and 5 in the known circuit (FIG. 1) will be compared using voltage formulas.

In the known circuit:

Signal (R) level $V_R=V_R+\Delta_0 V_0$ (R−L)

Signal (R) level $V_L=V_L-\Delta_0 V_0$ (R−L)

In the embodiment:

Signal (R) level $V_R=V_R+\Delta_0 V_0$ (R−L)$+\Delta_1 V_1$ (R−L)sin $\omega_1 t$ . . . (1)

Signal (L) level $V_L=V_L-\Delta_0 V_0$ (R−L)$+\Delta_1 V_1$ (R−L)sin $\omega_1 t$ . . . (2)

The sign $V_0$ denotes a differential signal output level with no phase modulation whereas $V_1$ a differential signal output level with phase modulation under the low-frequency oscillators 11 and 12. The sign $\Delta_0$ denotes the degree of phase delay with no phase modulation whereas $\Delta_1$ the degree of phase delay with phase modulation under the low-frequency oscillators 11 and 12. The sign $\omega_1$ denotes the angular frequency of oscillation at the frequencies f1 and f2 in the low-frequency oscillators 11 and 12, respectively.

The last term "sin $\omega_1 T$" in the formulas (1) and (2) represents that the delayed output varies periodically while modulated by the low-frequency oscillators 11 and 12.

As disclosed above, the present invention creates a constant fluctuation to the delayed output under phase modulation at extremely low frequencies (long cycle) in the range from 0.04 to 12 Hz, preferably from 4 to 12 Hz, thus achieving healing effects.

The present invention is based on resonant fluctuation caused by extremely-low electromagnetic waves, called Schummann resonance, created by a cavity, acting like a waveguide, formed in the space that separates the earth and the ionosphere, induced by electromagnetic impulses like those from lightning flashes. The fundamental frequency of nominal frequencies in Schummann resonance is about 8 Hz. Schummann resonance is gentle vibration created by the Earth as if it is a cradle. It is thought that this gentle vibration gives good effects not only to human beings but also all creatures on the Earth from ancient time.

Slow $\alpha$ waves (8 to 12 Hz) among brain waves of human beings will appear when he or she is relaxed and $\theta$ waves (4 to 8 Hz) are very stable brain waves that will appear when he or she is very relaxed for example in meditation. The bandwidth of these brain waves almost matches Schummann resonance frequencies.

It is thus thought that the fluctuation of the signal $\Delta$ (R−L), or variation (4 to 12 times per 1 sec.) in right and left sounds with a small time difference stimulates the brain of human beings to generates $\Delta$ or $\theta$ waves.

The relaxation effects based on $\alpha$ or $\theta$ waves are given to listeners as healing surround effects to enhance sound quality.

The phase-conversion surround circuit 10 shown in FIG. 2 is equipped with the band-pass filter 21 for signal addition in midrange, particularly, vocal range. The filter 21 protects vocal acoustic pressure from dropping which may otherwise occur at a long delay time set in the surround circuit 10. The band-pass filter 21 is a combination of known high-pass and low-pass filters, and hence the explanation of its operation being omitted.

One of the requirements for the phase-conversion surround circuitry 10 shown in FIG. 2 is that the constants for its devices and components be chosen to create a specific constant sound-image distance. Therefore, the phase-conversion surround circuitry 10 is particularly applicable to audio systems with fixed right/left speakers (constant distance), or audio systems with built-in speakers such as radio cassette recorders.

As disclosed in detail, the phase-conversion surround circuitry according to the present invention employs phase modulation to delayed signals to generate low-frequency fluctuation, which then offers healing surround effects.

Phase modulation is performed at two different oscillation frequencies in the range from 0.04 to 12 Hz, preferably from 4 to 12 Hz, corresponding to the $\alpha$ and $\theta$ waves, thus the present invention provides surround effects with emphasized tone difference.

What is claimed is:

1. A phase-conversion surround circuitry to give surround effects to right- and left-channel audio signals, comprising:

a phase delayer to delay an audio difference signal between the right- and left-channel audio signals, thus outputting a delayed audio difference signal;

a combiner to combine the delayed audio difference signal with the right- and left-channel audio signals, thus outputting composite audio signals; and a controller to oscillate at frequency of 12 Hz or less to periodically vary a time constant of the phase delayer.

2. The phase-conversion surround circuitry according to claim 1, wherein the phase delayer includes two phase-delay units connected in series, each delaying the audio difference signal by 90 degrees.

3. The phase-conversion surround circuitry according to claim 1, wherein the controller includes phase-delay controllers that oscillate at different frequencies in the range from 0.04 to 12 Hz.

* * * * *